US009333516B2

(12) United States Patent
Klintenstedt

(10) Patent No.: US 9,333,516 B2
(45) Date of Patent: May 10, 2016

(54) CENTRIFUGAL SEPARATOR HAVING A SUPPORT ELEMENT AND BEARING AROUND PORTIONS OF A SPINDLE

(75) Inventor: Kjell Klintenstedt, Saltsjö-Boo (SE)

(73) Assignee: ALFA LAVAL CORPORATE AB, Lund (SE)

( * ) Notice: Subject to any disclaimer, the term of this patent is extended or adjusted under 35 U.S.C. 154(b) by 785 days.

(21) Appl. No.: 13/636,293

(22) PCT Filed: Mar. 9, 2011

(86) PCT No.: PCT/SE2011/050257

§ 371 (c)(1),
(2), (4) Date: Jan. 25, 2013

(87) PCT Pub. No.: WO2011/119088

PCT Pub. Date: Sep. 29, 2011

(65) Prior Publication Data

US 2013/0130885 A1 May 23, 2013

(30) Foreign Application Priority Data

Mar. 22, 2010 (SE) ..... 1050263-1

(51) Int. Cl.
*B04B 1/08* (2006.01)
*B04B 9/12* (2006.01)
(Continued)

(52) U.S. Cl.
CPC ... *B04B 7/08* (2013.01); *B04B 1/08* (2013.01); *B04B 9/08* (2013.01); *B04B 9/12* (2013.01); *B04B 11/02* (2013.01); *B04B 11/06* (2013.01)

(58) Field of Classification Search
CPC ..... B04B 11/02; B04B 9/04; B04B 9/08; B04B 9/12; B04B 1/08; B04B 7/08; B04B 11/06
USPC ..... 494/43, 46, 67–73, 82–84, 1, 12; 464/179–180
See application file for complete search history.

(56) References Cited

U.S. PATENT DOCUMENTS 2,015,784 A * 10/1935 Brown ..... F16C 27/066 384/536
2,534,738 A * 12/1950 Scott ..... B04B 9/12 384/196

(Continued)

FOREIGN PATENT DOCUMENTS

EP 0211616 A2 2/1987
GB 310550 A 4/1929

(Continued)

OTHER PUBLICATIONS

Notification Concerning Transmittal of the International Preliminary Report on Patentability issued in PCT Application No. PCT/SE2011/050257 dated Oct. 4, 2012.

*Primary Examiner* — Charles Cooley
(74) *Attorney, Agent, or Firm* — MKG, LLC

(57) ABSTRACT

A centrifugal separator comprises a frame, a bearing device and a rotor having a first end and a second end. The rotor is connected to the frame via the bearing device. The rotor comprises a hollow spindle defining a central inner space. The spindle has a first portion adjoining the first end, an intermediate portion and a second portion adjoining the second end. The rotor also comprises a support element provided around the spindle, a separation space and separation discs are provided in the separation space around the first portion and against the support element. A rotor casing delimits the separation space. The support element is provided around the intermediate portion. The bearing device is connected to and provided around the second portion.

16 Claims, 1 Drawing Sheet

(51) Int. Cl.

| | |
|---|---|
| ***B04B 7/08*** | (2006.01) |
| ***B04B 9/08*** | (2006.01) |
| ***B04B 11/02*** | (2006.01) |
| ***B04B 11/06*** | (2006.01) |

(56) References Cited

U.S. PATENT DOCUMENTS

| | | | | | |
|---|---|---|---|---|---|
| 2,698,131 | A * | 12/1954 | Cook | B04B 9/12 | 384/536 |
| 2,913,169 | A * | 11/1959 | Wilsmann | B04B 9/12 | 494/15 |
| 3,432,091 | A | 3/1969 | Beazley | | |
| 4,568,324 | A * | 2/1986 | Williams | B04B 9/12 | 494/82 |
| 4,724,076 | A | 2/1988 | Deguchi et al. | | |
| 4,981,502 | A | 1/1991 | Gottschalk | | |
| 8,182,408 | B2 * | 5/2012 | Isaksson | B01D 45/14 | 494/70 |
| 9,079,193 | B2 * | 7/2015 | Klintenstedt | B04B 9/04 | |
| 2001/0012814 | A1 | 8/2001 | May et al. | | |
| 2009/0186752 | A1 * | 7/2009 | Isaksson | B01D 45/14 | 494/40 |
| 2011/0212820 | A1 * | 9/2011 | Klintenstedt | B04B 9/04 | 494/46 |
| 2013/0130885 | A1 * | 5/2013 | Klintenstedt | B04B 1/08 | 494/60 |
| 2014/0235422 | A1 * | 8/2014 | Isaksson | B04B 1/00 | 494/41 |

FOREIGN PATENT DOCUMENTS

| | | | |
|---|---|---|---|
| WO | 9109251 | A2 | 6/1991 |
| WO | 9965610 | | 12/1999 |
| WO | 2007133161 | A1 | 11/2007 |
| WO | 2010020936 | A1 | 2/2010 |

* cited by examiner

CENTRIFUGAL SEPARATOR HAVING A SUPPORT ELEMENT AND BEARING AROUND PORTIONS OF A SPINDLE

THE BACKGROUND OF THE INVENTION AND PRIOR ART

Technical Field

The present invention is directed to a centrifugal separator.

US2001/0012814 (FIG. 29) discloses a centrifugal separator having a hollow spindle forming a central space. The frame comprises an elongated stationary part extending in the central space of the spindle. This elongated stationary part has the function of a carrier for the bearing device comprising an upper bearing above the separation discs between the elongated part and the inside of the spindle, and a lower bearing below the separation discs between the elongated part and the inside of the spindle.

WO2007/133161 discloses a centrifugal separator having a hollow, tubular spindle and a centrifuge rotor of a conventional construction and mounted on the upper end of the spindle.

Centrifugal separators of conventional type have historically usually been constructed with a relatively long and thin spindle permitting the centrifuge rotor to swing or pivot laterally. All centrifugal separators have a number of critical numbers of revolutions at which such pivoting, or lateral deflection, of the centrifuge rotor arises. It is desirable to operate centrifugal separators at relatively high number of revolutions for achieving an efficient separation. Stable operation is obtained within a range of numbers of revolutions above the first critical number of revolutions.

Centrifugal separators of conventional type also have a limitation with respect to the height of the centrifuge rotor and the disc package located therein. This partly depends on the difficulties to achieve stable operation if the centrifuge rotor is high. In addition, it is difficult for a specific type or construction of centrifugal separator to be able to vary the height and how many separation discs that are to be included in the disc package. The specific construction disclosed in the above mentioned US2001/0012814 has in this context the disadvantage that the height is difficult to vary and increase due to the elongated stationary part and the provision of an upper bearing between the spindle and stationary part. Since the support element is connected to the spindle at the lower portion there is no possibility to carry the spindle merely below the support element and the separation discs.

Another problem of conventional centrifugal separators is the difficulties of manufacturing and mounting. Centrifugal separators consist of a plurality of various components such as spindle, drive components, one or more bearings, rotor and separation discs provided therein, etc. The mounting of these components is a time consuming and complicated task.

SUMMARY OF THE INVENTION

One object of the present invention is to remedy the above mentioned problems. The invention is aimed at a centrifugal separator that can be manufactured with a relatively high centrifuge rotor and that can be operated in a stable manner and in an easy way can be modified and adapted to centrifuge rotors of various heights. Furthermore, it is aimed at a construction enabling a simplified mounting of the centrifugal separator.

This object is achieved by the centrifugal separator defined herein in which a support element is provided around the intermediate portion of the spindle and that the bearing device is connected to and provided around the second portion of the spindle.

The hollow spindle thus has a carrying function since it extends through the whole, or substantially the whole, centrifugal separator and since the support element and the separation discs are mounted on and around the spindle. The spindle may be journaled and carried by a bearing device which is connected to merely the second lower portion. In such a way, the first upper portion of the spindle can be left relatively free for mounting of the separation discs. Feeding of the product to be separated and/or discharge of separated products to and from the separation space can take place via the first or second and the central space in the spindle.

According to an embodiment of the invention, the centrifugal separator comprises a first locking member which engages the first portion of the spindle and defines a stop and an end position for the set of separation discs. Advantageously, the centrifugal separator may also comprise a second locking member which engages the second portion of the spindle and is arranged to tighten the support element and the set of separation discs on the spindle against the first locking member. In such a way the mounting can be achieved in that the various components are guided onto the spindle and tightened between the first locking member and the second locking member. One of the locking members, for instance the second, may then be configured as a tie nut by means of which the components are tightened against each other and against the first locking member. The second locking member may advantageously also be arranged to tighten the bearing device against the first locking member.

According to an embodiment of the invention, the centrifugal separator comprises a compression disc provided around the spindle between the first locking member and the set of separation discs. The compression disc thus constitute one of the components that during the mounting can be guided onto the spindle and tightened between the set of separation discs and the first locking member. Advantageously, the compression disc may comprise a pipe portion extending around and abutting the first portion of the spindle and a compression portion abutting an uppermost separation disc in the set of separation discs.

According to an embodiment of the invention, the centrifugal separator comprises a force transmission element, which is provided around and fixedly connected to the spindle in a rotary direction and arranged to transmit a rotary movement to the spindle from a drive member. The force transmission element is advantageously provided between the bearing device and the support element. Also force transmission element may thus constitute one of the components which during the mounting can be guided onto the spindle and tightened between the support element and the bearing device. The force transmission element may comprise or consist of a pulley for a belt or chain driven by means of a drive motor or a gear wheel which via one or several further gear wheels is driven by a drive motor. The force transmission element may also be a carrier of a rotor of a drive motor, for instance an electric drive motor comprising a stator connected to the frame and provided inside or outside the rotor of the electric motor. The drive motor may also comprise or consist of a pneumatic motor or a hydraulic motor.

According to an embodiment of the invention, the centrifugal separator comprises a feed conduit for feeding of a product and at least a first discharge conduit for discharging a first phase, for instance a relatively light phase, of the product, wherein the feed conduit and the first discharge conduit extend into the central inner space, preferably via the second end.

According to an embodiment of the invention, the centrifugal separator comprises an inlet and outlet device which is provided in the central inner space and fixedly connected to the spindle in a rotary direction and arranged to convey the product from the feed conduit into the separation space via at least a feed opening of the spindle, and to convey the first phase from the separation space to the first discharge conduit via at least a first outlet opening of the spindle. The first phase may be conveyed into the stationary discharge conduit via a first outlet chamber. In one embodiment, the support element comprises a feed channel extending between the separation space and feed opening, and a first channel extending between the separation space and the first outlet opening.

According to an embodiment of the invention, the centrifugal separator also comprises a second discharge conduit for discharging a second phase, for instance a relatively heavy phase, of the product and wherein the second discharge conduit extends into the central inner space. In one embodiment, the inlet and outlet device is arranged to convey the second phase from the separation space to the second discharge conduit via at least a second outlet opening of the spindle. In one embodiment, the second phase is conveyed into the stationary discharge conduit via a second outlet chamber. In one embodiment, the support element also comprises a second channel extending between the separation space and the second outlet opening.

According to an embodiment of the invention, the rotary casing is connected to and provided against the support element. Furthermore, the rotary casing may have a first end connected to the first portion of the spindle.

BRIEF DESCRIPTION OF THE DRAWINGS

The invention is now to be explained more closely through a description of various embodiments and with reference to the drawings attached hereto.

DETAILED DESCRIPTION

Figure 1:
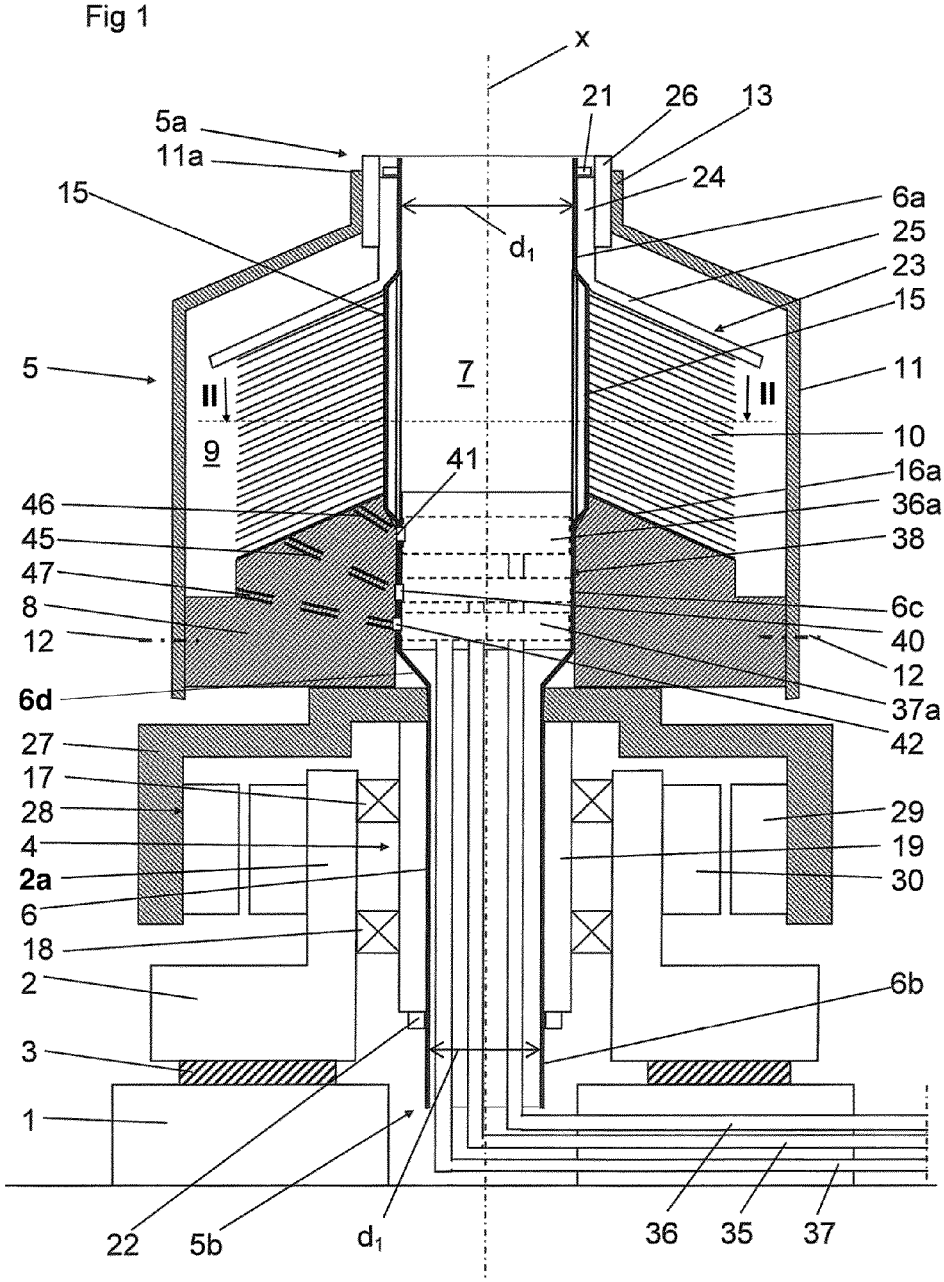
FIG. 1 discloses a sectional view through a centrifugal separator according to an embodiment of the invention.

FIG. 1 discloses a centrifugal separator comprising a fundament 1 which can be stationary or located on a floor, or formed by a floor. The centrifugal separator also comprises a frame 2 that is elastically connected to the fundament 1 via an elastic connection 3.

Furthermore, the centrifugal separator comprises a bearing device 4 and a rotor 5 having a first end 5*a* and a second end 5*b*. The rotor 5 is connected to the frame via the bearing device 4. The rotor 5 is rotatable in relation to the frame 2 and the fundament 1 around an axis x of rotation.

The rotor 5 comprises a spindle 6 which is hollow and defines a central inner space 7. The spindle 6 has a tubular shape or is designed as a pipe, preferably with a relatively thin wall. The spindle 6 has a first portion 6*a*, which adjoins the first end 5*a*, and second portion 6*b*, which adjoins the second end 5*b*. The spindle 6 also has an intermediate portion 6*c* extending between and connecting the first portion 6*a* and the second portion 6*b*. The bearing device 4 is connected to and provided around the second portion 6*b* of the spindle 6.

In the embodiment disclosed, the centrifugal separator is shown with a vertical axis of rotation, wherein the first end 5*a* of the rotor 5 forms an upper end and the second end 5*b* a lower end. It is to be noted that the centrifugal separator also can be oriented so that the axis x of rotation extends in other directions, for instance a horizontal direction, or in such a way that the first end 5*a* of the rotor 5 forms a lower end.

The first portion 6*a* has a first outer diameter d1. The second portion 6*b* has a second outer diameter d2. The first outer diameter d1 is larger, or significantly larger, then the second outer diameter d2. The relation d2/d1 may for instance lie in the range 0.3 to 0.9, preferably in the range 0.5 to 0.85 and more preferably in the range 0.6 to 0.80. In a preferred embodiment the relation d2/d1 may be 0.750.

The intermediate portion 6*c* has an outer diameter which decreases from the first outer diameter $d_1$ to the second outer diameter $d_2$. In the embodiment disclosed, the intermediate portion 6*c* comprises a transition portion 6*d* which is included in or forms a part of the intermediate portion 6*c* and which comprises this reduction of the outer diameter from $d_1$ to $d_2$.

The rotor 5 also comprises a support element 8, which is provided around and connected to the spindle 6, and a separation space 9. The support element 8 is provided around the intermediate portion 6*c* of the spindle 6. A set of separation discs 10 are provided in the separation space 9 around the first portion 6*a* and against or on the support element 8. The separation discs 10 thus in the embodiment disclosed rest on the support element 8. However, generally the support element 8 acts as a holder for the separation discs 10 which are prevented from moving in a direction towards the second portion 6*b* of the spindle 6. The separation discs 10 are in the embodiment disclosed to conical but they may also be plane and parallel with a plane that is perpendicular to the axis x of rotation, or have a curved generatrix.

It is also to be noted that the support element 8 may be shaped in one piece, as indicated in FIG. 1, or be composed of two or several components.

A rotor casing 11 delimits and encloses the separation space 8. The rotor casing 11 is provided against or on the support element 8, and is fixedly connected to the support element 8 by means of a suitable connection, for instance schematically indicated screws 12. The rotor casing 11 has a first end 11*a* which is connected to the first portion of 6*a* of the spindle 6 and which in the embodiment disclosed is located above the set of separation discs 10. At the first end 11*a* the rotor casing has a cylindrical portion 13.

Figure 2:
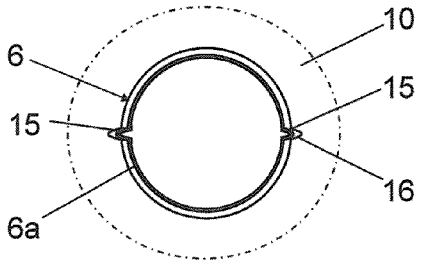
FIG. 2 discloses a cross-sectional view through a first portion of a spindle of the centrifugal separator in FIG. 1 taken across line II-II.

The spindle 6 comprises in the embodiment disclosed a longitudinal projection 15 which extends in parallel with the axis x of rotation and outwardly from an outer surface of the spindle 6, see FIG. 2. The projections 15 extend along a part of the first portion 6*a* into the intermediate portion 6*c*. The projections 15 may be shaped as bulges formed through local pressing of the tubular spindle 6. The projections 15 serve to lock the separation discs 10 against rotation in relation to the spindle 6 and engage corresponding recesses 16 of the separation discs 10. The projections 15 also have the purpose of locking the support element 8 against rotation in relation to the spindle 6 and engage corresponding recesses of the support element 8.

The bearing device 4 comprises in the embodiment disclosed two rotary bearings 17 and 18, for instance roller bearings or ball bearings. The bearing device 4 also comprises a bearing sleeve 19 which is fixedly provided on the spindle 6, and more precisely on the second portion 6*b* of the spindle 6. The two rotary bearings 17 and 18 are provided between the bearing sleeve 19 and a cylindrical part 2*a* forming a part of the frame 2.

The centrifugal separator comprises a first locking member 21 which engages the first portion 6*a* of the spindle 6 and defines a stop and an end position for the set of separation discs 10. The centrifugal separator also comprises a second locking member 22 which engages the second portion 6*b* of the spindle 6 and is arranged to tighten the bearing device 4, the support element 8 and the set of separation discs 10 on the spindle 10 against the first locking member 21. The bearing device 4 is in the embodiment disclosed tightened via the bearing sleeve 19. The locking members 21 and 22 may be configured in various ways, for instance as tie nuts, which are screwed onto a thread of a respective portion 6*a*, 6*b*, or as clamp rings tightened around the respective portion 6*a*, 6*b*.

Furthermore, the centrifugal separator comprises a compression disc 23 provided around the first portion 6*a* of the spindle 6 between the first locking member 21 and the set of separation discs 10. The compression disc comprises a tubular portion 24, which extends around and abuts the first portion 6*a* of the spindle 6, and compression portion 25, which abuts an uppermost separation disc 10 in the set of separation discs 10. The cylindrical portion 13 of the rotor casing 11 is provided outside the tubular portion 24 and slideable in relation to the tubular portion 24, for instance by means of a cylindrical sleeve 26. By means of the locking members 21, 22, the separation discs 10 may thus be pressed against each other between the compression disc 23 and the support element 8.

Furthermore, the centrifugal separator comprises a force transmission element 27, which is provided around and fixedly connected to the spindle 6 in a rotary direction, and arranged to transmit a rotary movement to the spindle 6 from a drive member 28. The force transmission element 27 is provided between the bearing device 4 and the support element 8. The force transmission element 27 is thus fixedly connected to the spindle 6, and in one embodiment also to the support element 8. In one embodiment, the force transmission element is tightened between the bearing device 4 and the support element 8, for instance through locking by force and/or shape.

The force transmission element 27 is in the embodiment disclosed carrier of a rotor 29 of the drive motor 28. In the embodiment disclosed, the drive motor 28 is an electric motor also comprising a stator 30 which is fixedly connected to the frame 2 and provided inside the rotor 29 of the drive motor 28.

In one embodiment, the drive motor 28 is also comprised of or consists of a pneumatic motor or a hydraulic motor. In one embodiment, the force transmission element comprises or consists of a pulley for a belt or chain driven by means of a drive motor or a gear wheel which via one or several further gear wheels is driven by a drive motor.

The centrifugal separator comprises a feed conduit 35 for feeding of a product and at least a first discharge conduit 36 for discharging of a first phase, for instance a relatively light phase, of the product. The feed conduit 35 and the first discharge conduit 36 are stationary, or non-rotating, and extends into the central inner space 7. The feed conduit 35 and the first discharge conduit 36 may advantageously be connected to the frame 2. The centrifugal separator also comprises a second discharge conduit 37 for discharging a second phase, for instance a relatively heavy phase, of the product. The second discharge conduit 37 is stationary, or non-rotating, and extends into the central inner space 7. The second discharge conduit 37 may also advantageously be connected to the frame 2.

The first phase is conveyed in the embodiment disclosed into the first discharge conduit 36 via a first outlet chamber 36*a* in the form of a closed chamber or a paring chamber having a paring disc provided on the first discharge conduit 36. The second phase is conveyed into the second discharge conduit 37 via a second outlet chamber 37*a* in the form of a closed chamber or via a paring chamber having a paring disc provided on the second discharge conduit 37.

The centrifugal separator also comprises an inlet and outlet device 38, which is provided in the central inner space 7 and fixedly connected to the spindle 6 in a rotary direction. The inlet and outlet device 38 is arranged to convey the product from the feed conduit 35 into the separation space 9 via at least a feed opening 40 of the intermediate portion 6*c* of the spindle 6. The inlet and outlet device 38 is also arranged to convey the first phase from the separation space 9 to the first discharge conduit 36 via at least a first outlet opening 41 of the intermediate portion 6*c* of the spindle 6. Furthermore, the inlet and outlet device 38 is arranged to convey the second phase from the separation space 9 to the second discharge conduit 37 via at least a second outlet opening 42 of the intermediate portion 6*c* of the spindle 6.

The support element 8 comprises a feed channel 45, a first channel 46 and a second channel 47. The feed channel 45 extends between the separation space 9 and the feed opening 40. The first channel 46 extends between the separation space 9 and the first outlet opening 41. The second channel 47 extends between the separation space 9 and the second outlet opening 42.

The invention is not delimited to the embodiments described but may be varied and modified within the scope of the following claims.

What is claimed is:

1. A centrifugal separator comprising a frame, a bearing device and a rotor having a first end and a second end, wherein the rotor, in relation to the frame, is rotatable around an axis of rotation and connected to the frame via the bearing device, wherein the rotor comprises:

a spindle, which is hollow and defines a central inner space, wherein the spindle has a first portion adjoining the first end, an intermediate portion and a second portion adjoining the second end, a support element, which is provided around and connected to the spindle, a separation space, a set of separation discs, which are provided in the separation space around the first portion of the spindle and against the support element, and a rotor casing that delimits the separation space, the support element being provided around the intermediate portion of the spindle and the bearing device being connected to and provided around the second portion of the spindle.

2. A centrifugal separator according to claim 1, wherein the centrifugal separator comprises a first locking member which engages the first portion of the spindle and defines a stop and an end position for the set of separation discs.

3. A centrifugal separator according to claim 2, wherein the centrifugal separator comprises a second locking member which engages the second portion of the spindle and is arranged to tighten the support element and the set of separation discs on the spindle against the first locking member.

4. A centrifugal separator according to claim 3, wherein the second locking member is arranged to tighten also the bearing device against the first locking member.

5. A centrifugal separator according to claim 2, wherein the centrifugal separator comprises a compression disc provided around the spindle between the first locking member and the set of separation discs.

6. A centrifugal separator according to claim 5, wherein the compression disc comprises a pipe portion extending around and abutting the first portion of the spindle and a compression portion abutting an uppermost separation disc in the set of separation discs.

7. A centrifugal separator according to claim 1, wherein the centrifugal separator comprises a force transmitting element, which is provided around and fixedly connected to the spindle in a rotary direction and arranged to transmit a rotary movement to the spindle from a drive member.

8. A centrifugal separator according to claim 7, wherein the force transmission element is provided between the bearing device and the support element.

9. A centrifugal separator according to claim 1, wherein the centrifugal separator comprises a feed conduit for feeding of a product and at least a first discharge conduit for discharging a first phase of the product, wherein the feed conduit and the first discharge conduit extend into the central inner space.

10. A centrifugal separator according to claim 9, wherein the centrifugal separator comprises an inlet and outlet device, which is provided in the central inner space and fixedly connected to the spindle in a rotary direction and arranged to convey the product from the feed conduit into the separation space via at least a feed opening of the spindle and to convey the first phase from the separation space to first discharge conduit via at least a first outlet opening of the spindle.

11. A centrifugal separator according to claim 10, wherein the support element comprises a feed channel extending between the separation space and the feed opening, and a first channel extending between the separation space and the first outlet opening.

12. A centrifugal separator according to claim 10, wherein the centrifugal separator also comprises a second discharge conduit for discharging a second phase of the product and wherein the inlet and outlet device is arranged to convey the second phase from the separation space to second discharge conduit via at least a second outlet opening of the spindle.

13. A centrifugal separator according to claim 12, wherein the support element comprises a second channel extending between the separation space and the second outlet opening.

14. A centrifugal separator according to claim 9, wherein the centrifugal separator also comprises a second discharge conduit for discharging a second phase of the product and wherein the second discharge conduit extends into the central inner space.

15. A centrifugal separator according to claim 1, wherein the rotary casing is connected to and provided against the support element.

16. A centrifugal separator according to claim 1, wherein the rotary casing has a first end which is connected to the first portion of the spindle.

* * * * *